US006789282B1

(12) United States Patent
Frydman

(10) Patent No.: US 6,789,282 B1
(45) Date of Patent: Sep. 14, 2004

(54) LEG PILLOW WITH SINGLE CLASP

(76) Inventor: Jonathan David Frydman, 195 Charles Street, Thornhill, Ontario (CA), L4J 3A2

( * ) Notice: Subject to any disclaimer, the term of this patent is extended or adjusted under 35 U.S.C. 154(b) by 0 days.

(21) Appl. No.: 10/409,258

(22) Filed: Apr. 8, 2003

(51) Int. Cl.[7] ..... A47C 16/00
(52) U.S. Cl. ..... 5/648; 5/630
(58) Field of Search ..... 5/630, 648, 649–651, 5/621, 624

(56) References Cited

U.S. PATENT DOCUMENTS

| | | | | | |
|---|---|---|---|---|---|
| 4,573,456 | A | * | 3/1986 | Spann | 602/27 |
| 5,216,771 | A | | 6/1993 | Hoff | |
| 5,533,218 | A | * | 7/1996 | Fahy | 5/636 |
| 6,154,905 | A | | 12/2000 | Frydman | |
| 6,182,314 | B1 | * | 2/2001 | Frydman | 5/648 |
| 6,578,218 | B2 | * | 6/2003 | Wassilefsky | 5/648 |

* cited by examiner

*Primary Examiner*—Teri Pham Luu
*Assistant Examiner*—Fredrick Conley
(74) *Attorney, Agent, or Firm*—Webb Ziesenheim Logsdon Orkin & Hanson, P.C.

(57) ABSTRACT

A leg pillow having two opposing arcuate-shaped bolsters that defines a thigh channel. The bolsters are connected by a bridge having airflow channels on its upper surface and flex channels on its lower planar surface. The bolsters have terminal ends curving inward that form a friction fitting single leg clasp capable of clasping securely an inner thigh of an individual. The clasping of the thigh causes a deformation of the leg pillow which, when the alternate inner thigh rests on the lower planar surface of the bridge opposite the thigh channel, the flex channels therein allow for substantial conformity to the unique contours of the individual's lower body region, thus alleviating stress on the spine and maintaining the spine's natural alignment. The unique features of the present invention resist movement into the unhealthy prone or supine sleeping position and prevent shifting of the pillow while asleep.

14 Claims, 4 Drawing Sheets

LEG PILLOW WITH SINGLE CLASP

BACKGROUND OF THE INVENTION

1. Field of the Invention

The present invention relates to orthopedic support devices for minimizing spinal stress while an individual is in the lying position. More particularly, the present invention relates to an orthopedic support leg pillow.

2. Description of Related Art

Spinal related complaints are very common. In fact, back pain is the second most common complaint, behind the common cold, for visits to the family doctor. Proper spinal support (whether related to the lower back, upper back, or neck) has been a concern for decades. This has resulted in a significant variety of products designed to provide greater comfort and support.

The majority of these products are designed for about 95 percent of the population. As all individuals vary anatomically and each individual has personal preferences, the customization of spinal support products to all individuals would be impractical, if not impossible. Methods of customization for both the cervical and lumbar spine have been attempted through intricate systems of support that are adjustable to the needs of the individual, such as inflatable means, fluid-filled means, or a combination of self-attachment using hook and loop fastening devices, zippers or strapping. All of these methods, although effective, are extremely costly from a manufacturing standpoint. Moreover, none of these products, whether designed to support the cervical or lumbar spine, ever consider the specific needs of the individual user. For all of the above reasons, a need exists for an orthopedic support pillow that is capable of being customized to the individual's needs as opposed to the individual conforming to the product.

The present invention overcomes many of the problems of the prior art in that it provides a capability for customization of an orthopedic support leg pillow to fit the individual's needs without the use of accessory application devices, such as hook and loop, elastic bands, zippers or straps.

It is generally known that maintaining proper posture of the spine helps to prevent the occurrence of spinal injury and back pain. The preferred proper spinal posture in all daily sitting and upright activities includes a slight lordotic curve in the lumbar region of the spine, or what is known as the "neutral spine" position. This spinal position minimizes stress on the spine, which allows the spine to maintain a naturally curved position. For example, it is commonly known that when lifting heavy objects, an individual should bend their knees to lift such objects and that the back should be maintained in the neutral spine position to alleviate any potential stress to the spine which can lead to back pain and/or spinal injury.

With the recent interest in ergonomics and in prevention of repetitive trauma injuries in the work place, sleep ergonomics has been, for the most part, neglected, even though an average of one-third of an individual's life is spent sleeping. It must be appreciated, therefore, that merely lying down is not sufficient for spinal stress reduction, and that proper sleep postural maintenance is essential for a comfortable and restful sleep.

Generally, it is recommended that one avoid the prone position (lying on one's stomach) while sleeping, because of the aggravated stress on the lumbar spine (accentuation of the lordotic curve) and the rotational positioning of the cervical spine, which could result in neck pathomechanics over time. The supine position (lying on one's back) has been promoted. However, unless there is appropriate flexion at the knee, this position also causes an accentuated lumbar lordotic curve. In other words, when lying on one's back, it is natural for the legs to lie flat on the sleeping surface. In this manner, the legs cooperate with the buttocks to act as a lever that raises the lumbar region of the spine, thereby causing an unnatural accentuation of the lordotic curve that may cause stress on the spine. This spinal stress would be alleviated if an individual slept with their knees bent. This sleeping position reduces the stress on the lumbar region of the spine and allows the spine to rest flatly against the sleeping surface. However, without some type of leg support, the natural tendency of the knees is to flatten out.

Lying on one's side is another preferred sleep position. Without the appropriate support, however, the lumbar spine has a tendency to be affected by rotational stresses due to torquing forces between the upper and lower body. In the side-lying position, the legs of the individual are generally maintained in an overlying relationship with each other. Positioning the legs in this manner, along one side of the body, causes the body to compensate for this position which may result in stress on the spine. In order to minimize these stresses, it is necessary to know both human anatomy as well as the physical forces acting on the spine. Simply relieving gravitational stress from the spine is not sufficient to reduce spinal stress and strain.

Several devices have been proposed to alleviate stress on the spine of an individual while sleeping. Such devices include large pillows or other supporting devices placed between the upper thighs of an individual to maintain a side-lying position. These pillows extend out and away from the front and back areas of the individual to block, or prevent the individual from rolling over. Such devices are well known in the art and a variety of such pillows are available. One problem associated with these devices arises from the natural tendency of people to roll or shift positions while sleeping. Such movement can cause these pillows to shift or move from the preferred position of being in-between the thighs, thereby defeating the purpose of the pillow or causing the sleeper to awaken in order to readjust the pillow. Some side-lying devices have overcome this problem by adding straps to secure the pillow to the thighs. However, it is not desirable to secure the pillow in this manner, especially in the event of a fire or other emergency. To overcome some of these problems, U.S. Pat. No. 5,216,771 proposed a leg pillow essentially hourglass in shape having two concave regions opposite one another that receive the inner thighs of an individual in a side-lying position, or for placing under the legs while lying in the supine position. These leg pillows do not provide the ability to firmly clasp onto a leg for a secure fit. Moreover, these pillows are incapable of substantially conforming to the unique contours of an individual's legs. Other leg pillows, such as shown in U.S. Pat. No. 6,154,905, have proposed two concave regions for receiving the inner thighs of an individual. Still other biconcave leg pillows have an insert into one of the concave regions to form essentially a flat surface, as shown in FIG. 1. The insert may be used as a neck pillow. The insert, however, must be removed before it can be used as a leg pillow since the insert essentially immobilizes the pillow, forming a rigid structure that is incapable of engaging an individual's legs.

Thus, a need exists for an orthopedic leg support pillow that can clasp an individual's leg so as to provide a more comfortable and secure fit and that will not shift or move while the individual is sleeping.

SUMMARY OF THE INVENTION

A primary object of the present invention is to provide a customized orthopedic leg support device that has a natural, secure, and comfortable fit that can be utilized to support and maintain an individual's natural spinal alignment while reclining in a side-lying position.

It is yet another object of the present invention to provide a customized orthopedic leg support device which maintains the normal anatomical position of the lower limbs when side lying in order to minimize stress on the lumbar spine, sacroiliac joints, and femoral acetabular joints.

These and other objects of the present invention are achieved by providing a leg pillow with a thigh channel and bolsters that are connected by a bridge having an upper surface and a planar lower surface. The pillow has at least one flex channel, preferably one on each end of and adjacent to the lower surface of the bridge, making the bridge deformable and resilient. The upper surface of the bolsters has terminal ends that define a single leg clasp for clasping a first inner thigh of a user. A second inner thigh is placed onto the lower planar surface of the resilient bridge, and the flex channels allow the bridge to exactly conform to the contours of the second inner thigh. Optionally, the upper surface of the bridge has spaced airflow channels that ventilate the space between the thighs.

The invention also includes a method of providing orthopedic support to the user reclining in a side-lying position. The bolsters are pivoted outward to open the thigh channel, and the user inserts a first thigh into the thigh channel. The terminal ends of the bolsters clasp the first thigh with a friction fit when the pivoted bolster returns to its original position. The first thigh and the bridge are then placed over the second thigh. The bridge and bolsters are then flexed with respect to one another to exactly conform the pillow to the second thigh. The unique features of the present invention prevents rotation by the user into an undesirable prone position and also reduces spinal stress while asleep.

The thigh channel is preferably C-shaped, and the pillow may be made from polyurethane foam. The thigh channel has an arc of curvature of at least 270°, and preferably about 350°.

BRIEF DESCRIPTION OF THE DRAWINGS

Other objects and advantages of the invention will become apparent from the following detailed description taken in conjunction with the accompanying drawings, in which.

DETAILED DESCRIPTION OF THE PREFERRED EMBODIMENT

Figure 1:
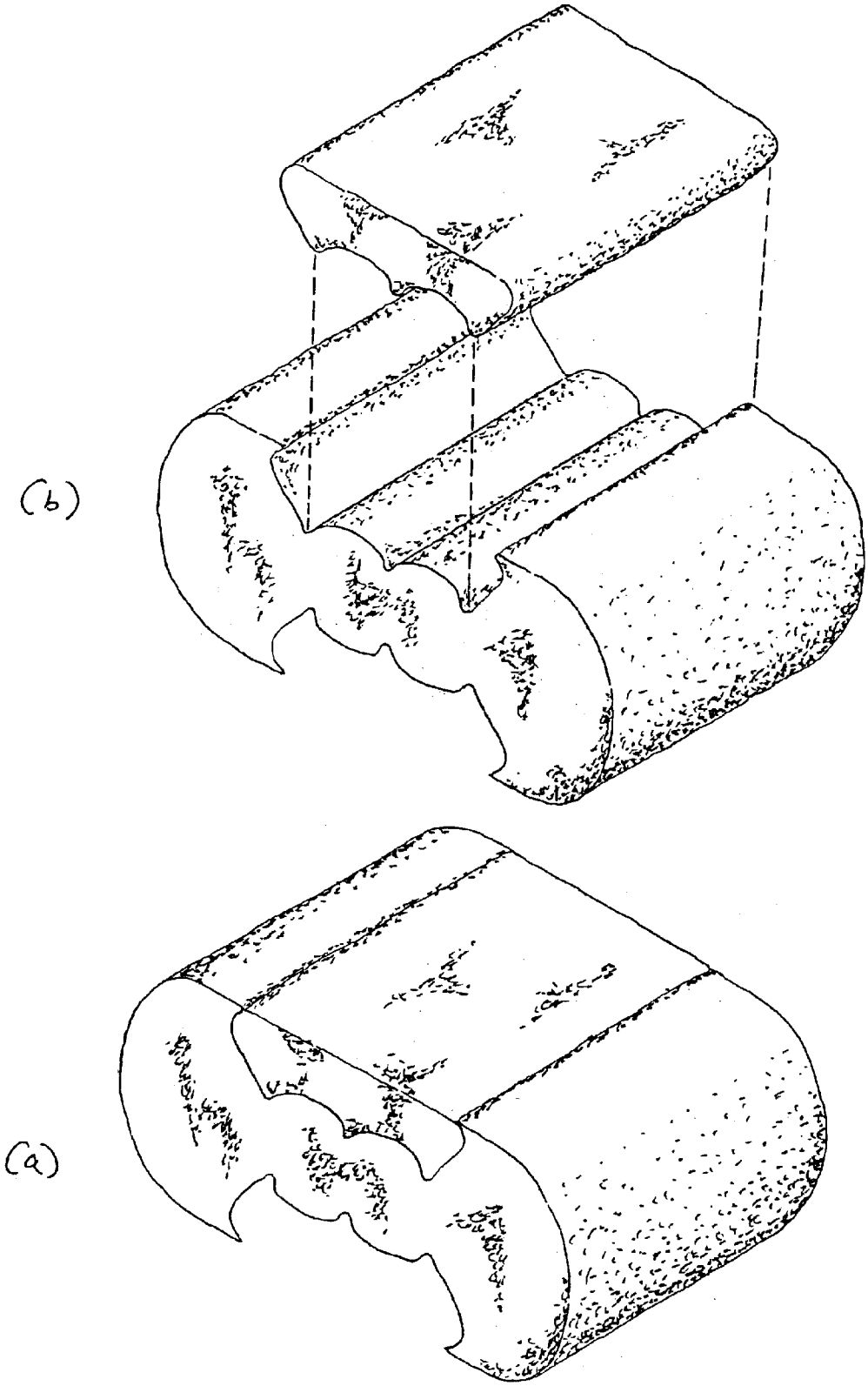
FIG. 1 (PRIOR ART)
FIGS. 1(*a*) and (*b*) is a prior art leg support pillow with a removable insert for neck support.
Figure 2:
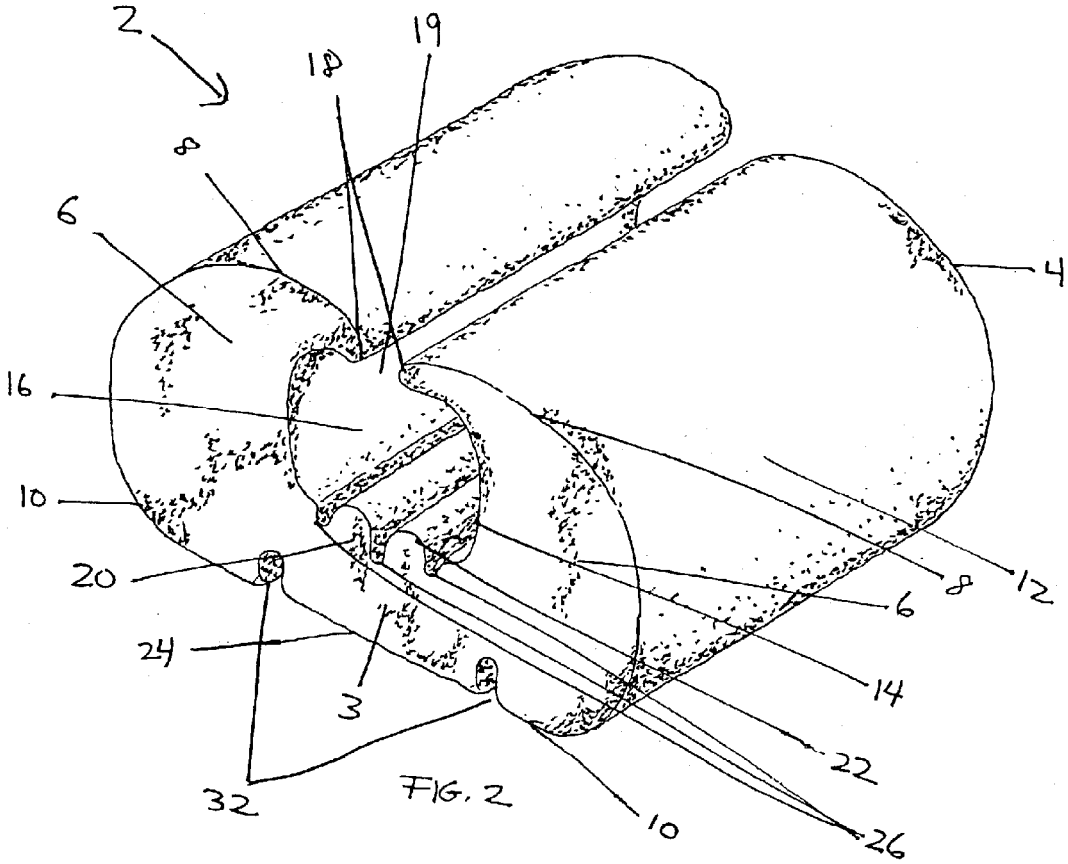
FIG. 2 is a perspective view of a leg support pillow according to the invention.
Figure 3:
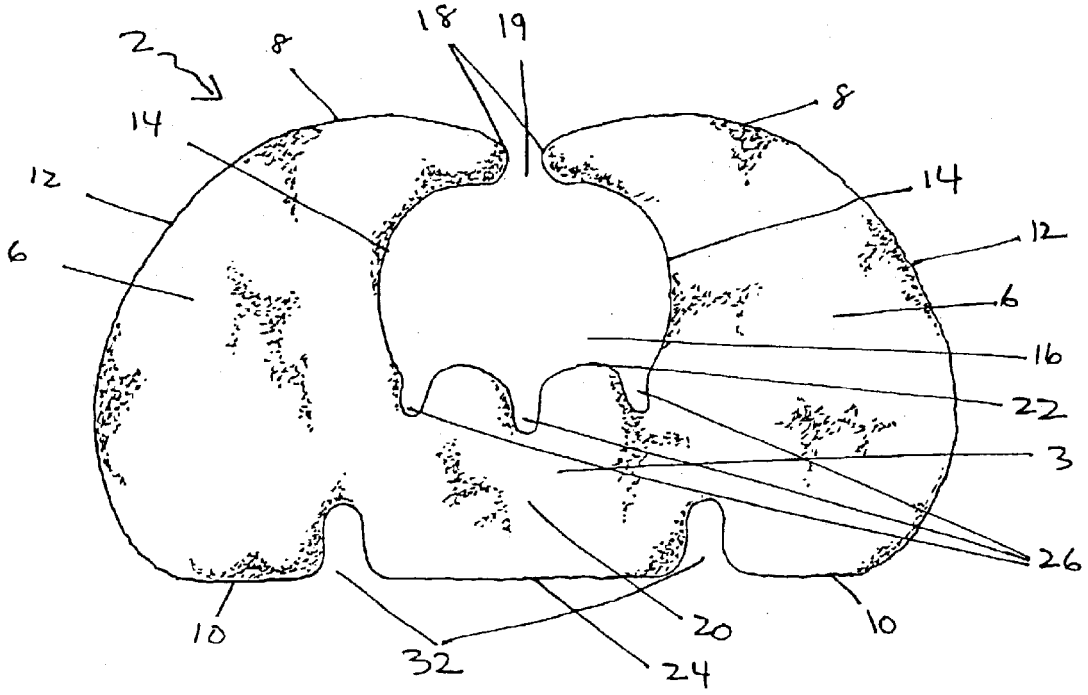
FIG. 3 is a front view of the leg support pillow of FIG. 2.
Figure 4:
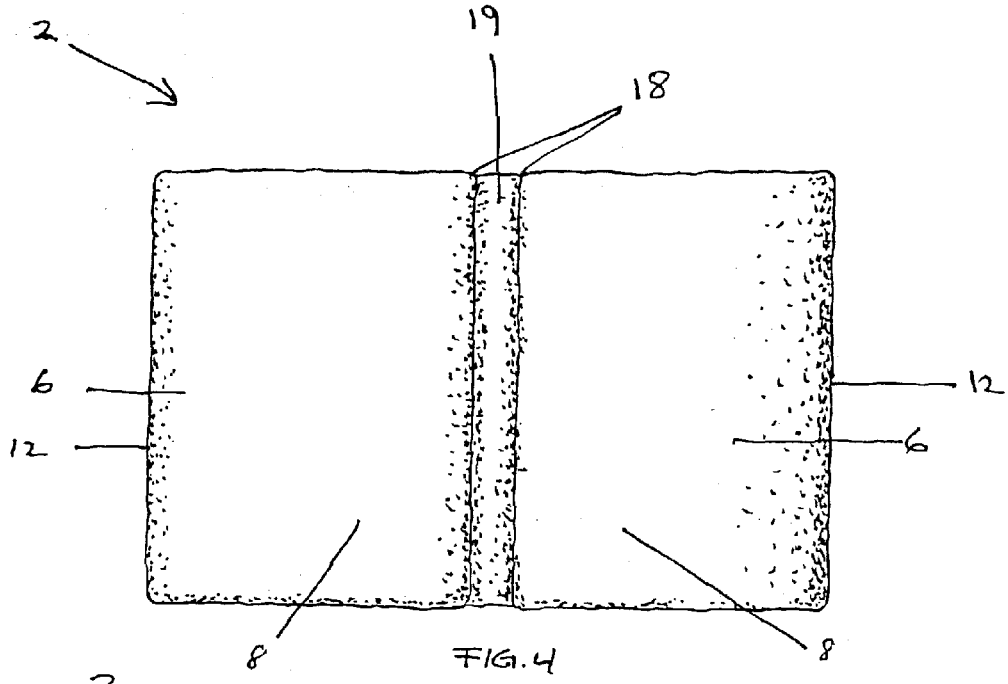
FIG. 4 is a top view of the leg support pillow of FIG. 2.
Figure 6:
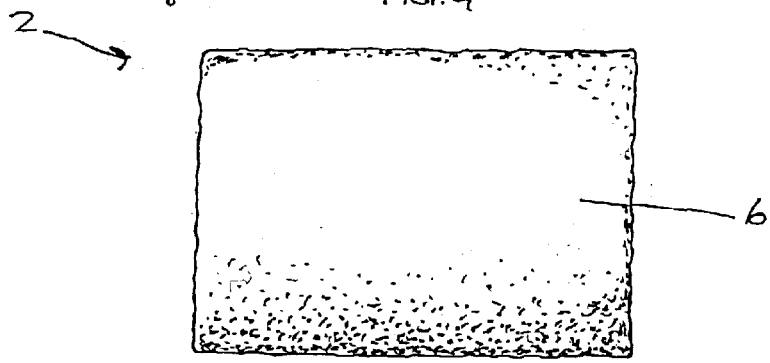
FIG. 6 is an end view of the leg support pillow of FIG. 2.
Figure 5:
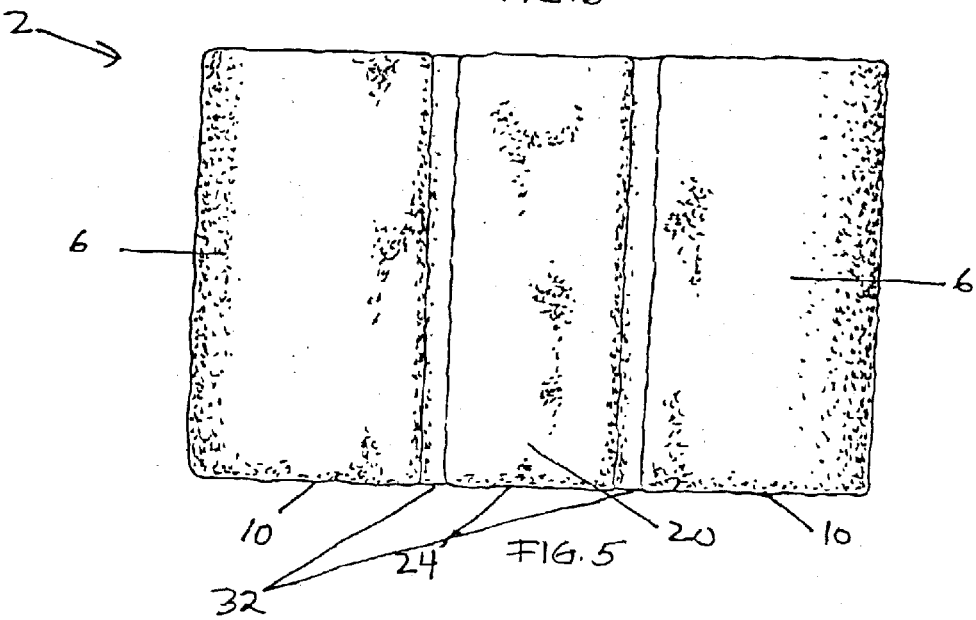
FIG. 5 is a bottom view of the leg support pillow of FIG. 2.

As shown in the drawings for purposes of illustration, the invention is generally embodied in a leg pillow 2, shown in FIGS. 2–6. The leg pillow 2 is preferably made of one-piece, molded polyurethane foam. Two opposing bolsters 6 have an upper surface 8, a planar lower surface 10, an arcuate outer surface 12, and an inner surface 14. The pillow 2 has a front side 3 and a back side 4. The upper surfaces 8 of the bolsters 6 are inwardly directed to form two terminal ends 18. The terminal ends 18 oppose one another to form a single leg clasp 19, as shown in FIGS. 2–4. The inner surface 14 of each bolster 6 and the leg clasp 19 define a thigh channel 16 that is generally C-shaped and has an arc of curvature of at least 270°. Extending between and connecting to the two bolsters 6 is a bridge 20 that has an upper surface 22 and a planar lower surface 24. The planar lower surface 24 lies opposite the thigh channel 16. Included within the lower planar surface 24 of the bridge 20 are two flex channels 32, each one located between a respective bridge 20 and its adjacent bolster 6, as shown in FIGS. 2–5. Included within the upper surface 22 of the bridge 20 are three spaced airflow channels 26. The two outer airflow channels 26 generally lie opposite the two flex channels 32, as shown in FIGS. 2 and 3.

Thus configured, the leg pillow 2 presents the appearance of two bolsters 6 having generally convex outer surfaces 12 that curve upward and inward to form terminal ends 18. The inner surfaces 14 of the bolsters 6 define a C-shaped thigh channel 16, wherein the opening forms the leg clasp 19 that is defined by the two terminal ends 18 of the bolsters 6, as shown in FIGS. 2–4. The two terminal ends 18 extend along the pillow 2 from the front side 3 to the back side 4 to form resilient fingers, which perform a clasping function as described in greater detail below. The thigh channel 16 extends across the pillow 2 from the front side 3 to the back side 4 with an opening at the upper surface 8 of the bolsters 6, as shown in FIGS. 2–4. The lower planar surfaces 10 of the bolsters 6 are preferably coplanar with the lower planar surface 24 of the bridge 20 to form an essentially flat bottom surface 30, as shown in FIG. 3. The two flex channels 32 contained within the flat bottom surface 30 extend along the pillow 2 from the front side 3 to the back side 4.

Figure 7:
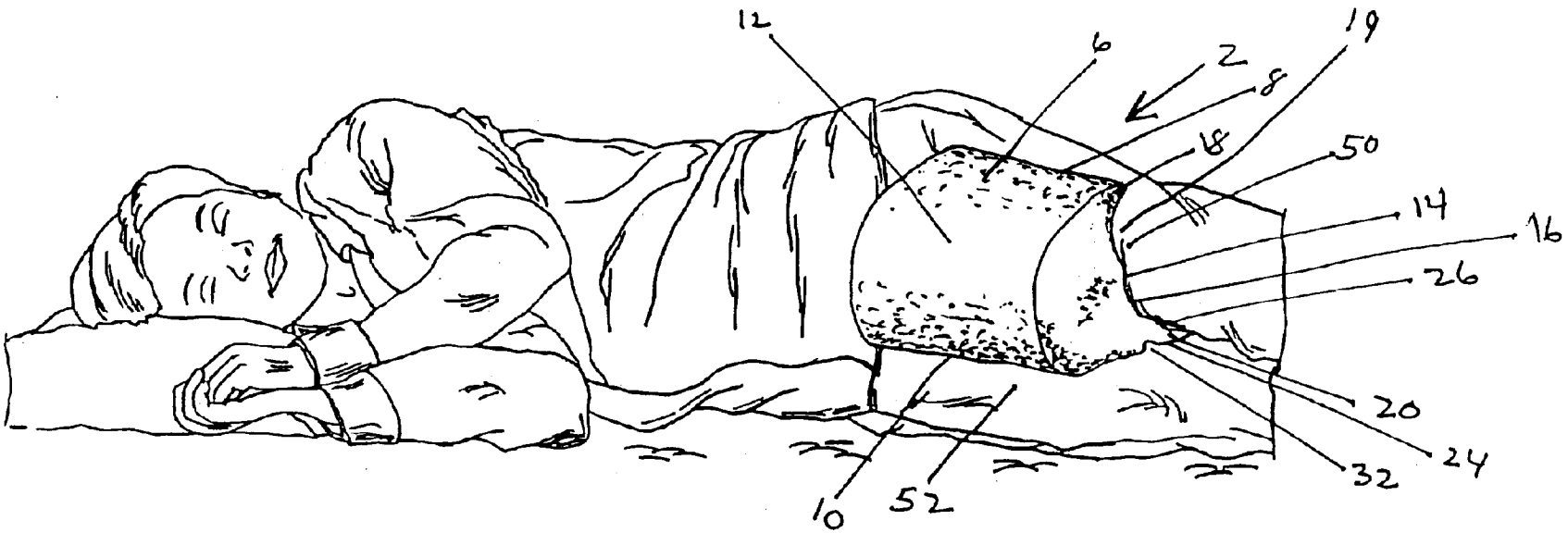
FIG. 7 is a perspective view of the leg support pillow being used while an individual is in the side-lying position with one thigh securely engaged within the single leg clasp and the other thigh resting inside the flexible planar region.

The leg pillow 2 of the preferred embodiment can be used to reduce spinal stress while in the side-lying position. As shown in FIG. 7, the first inner thigh 50 of an individual is placed within the single leg clasp 19 of the pillow 2 and the second inner thigh 52 is placed in the center of the lower planar surface 24 of the bridge 20. The single leg clasp 19 includes deform able, resilient terminal ends 18 which, when forced to spread apart, provide an opening for the receipt of the first inner thigh 50 of an individual. The terminal ends 18, when released, are resilient and thus return to their original position thereby clasping the first inner thigh 50 in a secure, contoured engagement with a friction fit. The bolsters 6 pivot (via flex channels 32) to allow for insertion and removal of the thigh from the thigh channel 16.

The lower planar surface 24 of the bridge 20 is deformable and resilient as a result of the two flex channels 32 contained therein. This allows the bridge 20 to exactly conform to the contours of the second inner thigh 52 when the second inner thigh 52 comes in contact with the lower planar surface 24 of the bridge 20. Particularly, when the inner thighs engage the pillow, the position and compression of the legs cause the bridge 20 to compress. Flex channels 32 permit the bolsters 6 to pivot with respect to the bridge 20, and the planar lower surface 24 thus conforms to the second inner thigh 52. Likewise, the upper surface 22 of the bridge 20 is compressed so as to conform to the first inner thigh 50. The leg pillow 2 thus conforms to the unique contours of the individual's lower body anatomy and resists disengagement from tossing and turning by the individual without any discomfort caused by the engagement of the pillow with the thighs.

Once in place, the arcuate-shaped bolsters 6 extend out from the front and back sides of the individual reclining in a side-lying position, as shown in FIG. 7. The bulk of the two bolsters 6 are of sufficient size and rigidity to resist any action of the sleeping individual attempting to roll over onto the prone or supine positions. Also, the leg clasp 19 secures the pillow into position to thus prevent uncomfortable shifting of the pillow during sleep. The bridge 20 secured between the thighs produces a gap between the thighs 55 that resists the natural tendency of the upper knee 57 to lie on top of the lower knee 59. Airflow channels 26 prevent moisture and temperature build-up on the thighs. The gap between the knees, preferably 2 to 4 inches, relieves the torsional stress on the spine created by the undesired rotation of the upper leg. Thus, the leg pillow 2 not only prevents rotation by the individual into an undesirable prone position, but also reduces spinal stress while in the side-lying position by placing a comfortable, naturally aligned space between the upper knee 57 and the lower knee 59.

While the present invention has been described with respect to the presently preferred embodiment, it is not intended that such details be regarded as limitations upon the scope of the invention.

What is claimed is:

1. A leg pillow with only one clasp, comprising:

two opposing bolsters, each having an outer surface and an inwardly directed terminal end, said terminal ends opposing one another to form a single leg clasp;

a single thigh channel defined by said bolsters and said leg clasp;

a bridge extending between said bolsters, opposite said leg clasp, said bridge having an upper surface and a planar lower surface, said lower surface opposite said thigh channel; and two flex channels in said leg pillow to facilitate pivotal movement of said bolsters with respect to said bridge, one flex channel on each end of and adjacent to the lower surface of said bridge.

2. The leg pillow of claim 1, wherein said bolsters have planar lower surfaces corresponding to the planar lower surface of said bridge, wherein each flex channel separates the planar lower surface of said bridge from the planar lower surface of an adjacent bolster.

3. The leg pillow of claim 1, wherein the thigh channel defined by said bolsters is C-shaped, said thigh channel having an arc of curvature of at least 270°.

4. The leg pillow of claim 3, wherein the curvature of said thigh channel traces an arc of about 350°.

5. The leg pillow of claim 1, wherein the upper surface of said bridge has at least one airflow channel therein.

6. The leg pillow of claim 1, wherein said pillow is made from polyurethane foam.

7. The leg pillow of claim 1, wherein the outer surface of each bolster is arcuate and curves upward and inward to said terminal end.

8. The leg pillow of claim 7, wherein said terminal ends are located below the highest point on said arcuate outer surfaces.

9. A leg pillow, comprising:

two opposing bolsters, said bolsters having arcuate outer surfaces that curve upward and inward to form terminal ends, said terminal ends opposing one another to form a leg clasp;

a thigh channel defined by said bolsters and said leg clasp, wherein said thigh channel has an arc of curvature of about 350° and wherein an opening is defined between said terminal ends;

a bridge extending between said bolsters, opposite said leg clasp, said bridge having an upper surface and a planar lower surface, said lower surface opposite said thigh channel, wherein said bolsters have planar lower surfaces corresponding to the planar lower surface of said bridge;

three airflow channels spaced apart in said upper surface of said bridge, adjacent said thigh channel; and two flex channels, each flex channel separating the planar lower surface of said bridge from the adjacent lower surface of said bolsters to facilitate pivotal movement of said bolsters with respect to said bridge, wherein the leg pillow is made of polyurethane foam.

10. The leg pillow of claim 9, wherein the terminal ends are located below the highest point on said arcuate outer surfaces.

11. The leg pillow of claim 9, wherein the thigh channel is C-shaped.

12. A method of providing orthopedic support to a user when in a side-lying position using a leg pillow with a single thigh channel, comprising:

positioning a resilient leg pillow having two bolsters, a bridge, and a single thigh channel adjacent a first thigh of the user, said pillow having a planar lower surface;

pivoting at least one of the bolsters outward to open the thigh channel;

inserting the first thigh within the thigh channel adjacent the bridge;

clasping the first thigh in the thigh channel with a friction fit upon resilient return of the at least one pivoted bolster toward its original position;

positioning the first thigh and the bridge over a second thigh;

lowering the first thigh to thereby place the bridge onto the second thigh; and flexing the bridge and the bolsters with respect to one another to deform the lower planar surface and conform the pillow to the second thigh.

13. The method of claim 12, including the step of ventilating the space between the first thigh and the bridge.

14. The method of claim 12, including the step of resisting by means of the bolsters any action of the user attempting to roll over into the prone or supine position.

* * * * *